United States Patent [19]

Wilson et al.

[11] Patent Number: 5,040,680

[45] Date of Patent: Aug. 20, 1991

[54] DISPENSING CONTAINER

[75] Inventors: Daniel C. Wilson, Taylors, S.C.; Rodney D. Borst, Oregon, Wis.

[73] Assignees: Dow Brands, Inc., Indianapolis, Ind.; Placon Corporation, Madison, Wis.

[21] Appl. No.: 571,028

[22] Filed: Aug. 22, 1990

Related U.S. Application Data

[63] Continuation of Ser. No. 333,325, Apr. 5, 1989, abandoned.

[51] Int. Cl.[5] ..... B65D 73/00

[52] U.S. Cl. ..... 206/459; 206/438; 206/494; 206/812; 220/339

[58] Field of Search ..... 206/438, 494, 812; 220/342, 339; 229/125.11

[56] References Cited

U.S. PATENT DOCUMENTS

| | | | |
|---|---|---|---|
| 2,577,304 | 12/1951 | Brooks | 229/125.11 |
| 3,035,752 | 5/1962 | Tedeschi | 229/125.11 |
| 3,148,103 | 9/1964 | Gallagher | 220/339 |
| 3,648,833 | 3/1972 | Dash | 229/125.11 |
| 4,401,229 | 8/1983 | Bell et al. | 229/125.11 |
| 4,428,497 | 1/1984 | Julius et al. | 220/339 |
| 4,735,317 | 4/1988 | Sussman et al. | 206/494 |
| 4,739,900 | 4/1988 | Borst | 220/339 |
| 4,770,320 | 9/1988 | Miles | 206/494 |
| 4,848,575 | 7/1989 | Nakamura et al. | 206/494 |
| 4,903,837 | 2/1990 | Duello | 200/494 |

*Primary Examiner*—Joseph Man-Fu Moy

[57] ABSTRACT

A dispensing container for packaging a product for presentation upon a retail shelf comprising of a bottom sheet, a thermoformed concave tray attached to the bottom sheet and defining therebetween a space, product within the space, the thermoformed concave tray defining an opening, a thermoformed semirigid lid covering the opening, a flexible adhesive substrate attached to the thermoformed lid and the thermoformed concave tray hinging the thermoformed lid to the thermoformed concave tray; and printed indicia on the adhesive substrate hinge.

3 Claims, 2 Drawing Sheets

DISPENSING CONTAINER

This application is a continuation, of application Ser. No. 07/333,325, filed 4/05/89 now abandoned.

BACKGROUND OF THE INVENTION

This invention relates generally to the art of dispensing and more particularly to a package assembly for dispensing towellettes.

A variety of dispensing containers have been developed and utilized for displaying, containing and dispensing a variety of towel-type products. One such device is described in U. S. Pat. No. 3,819,043 wherein folded tissues or towellettes are dispensed from a tray having a removable cover and with the cover provided with an opening and a flexible flap such that the flap is flexed and deformed to expose the opening but which upon relieving of that deformity responds to cover the opening. The flexible flap may be integral with the removable lid or adhered thereto by tape.

U. S. Pat. No. 1,777,508 discloses a display device which simulates a container opening and appears to display an opened container. Two members are attached to one another by a support member which maintains the configuration of the two members so as to maintain the appearance of an opened container.

SUMMARY OF THE INVENTION

It is thus an object of this invention to provide a novel dispensing container.

It is a further object of this invention to provide a novel dispensing container which contains towellettes and which has a covering thereon so that towellettes may be dispensed upon an opening of the covering.

It is a further and yet more particular object of this invention to provide such a novel dispensing container so as to have a novel relationship between the cover and an opening for the dispensing of a product from within the container.

These as well as other objects are accomplished by a dispensing container comprising a package of product for presentation upon a retail shelf comprising of a bottom sheet, a thermoformed concave tray attached to the bottom sheet and defining therebetween a space, product within the space, the thermoformed concave tray defining an opening, a thermoformed semirigid lid covering the opening, a flexible adhesive substrate attached to the thermoformed lid and the thermoformed concave tray hinging the thermoformed lid to the thermoformed concave tray; and printed indicia on the adhesive substrate hinge.

DETAILED DESCRIPTION

Figure 1:
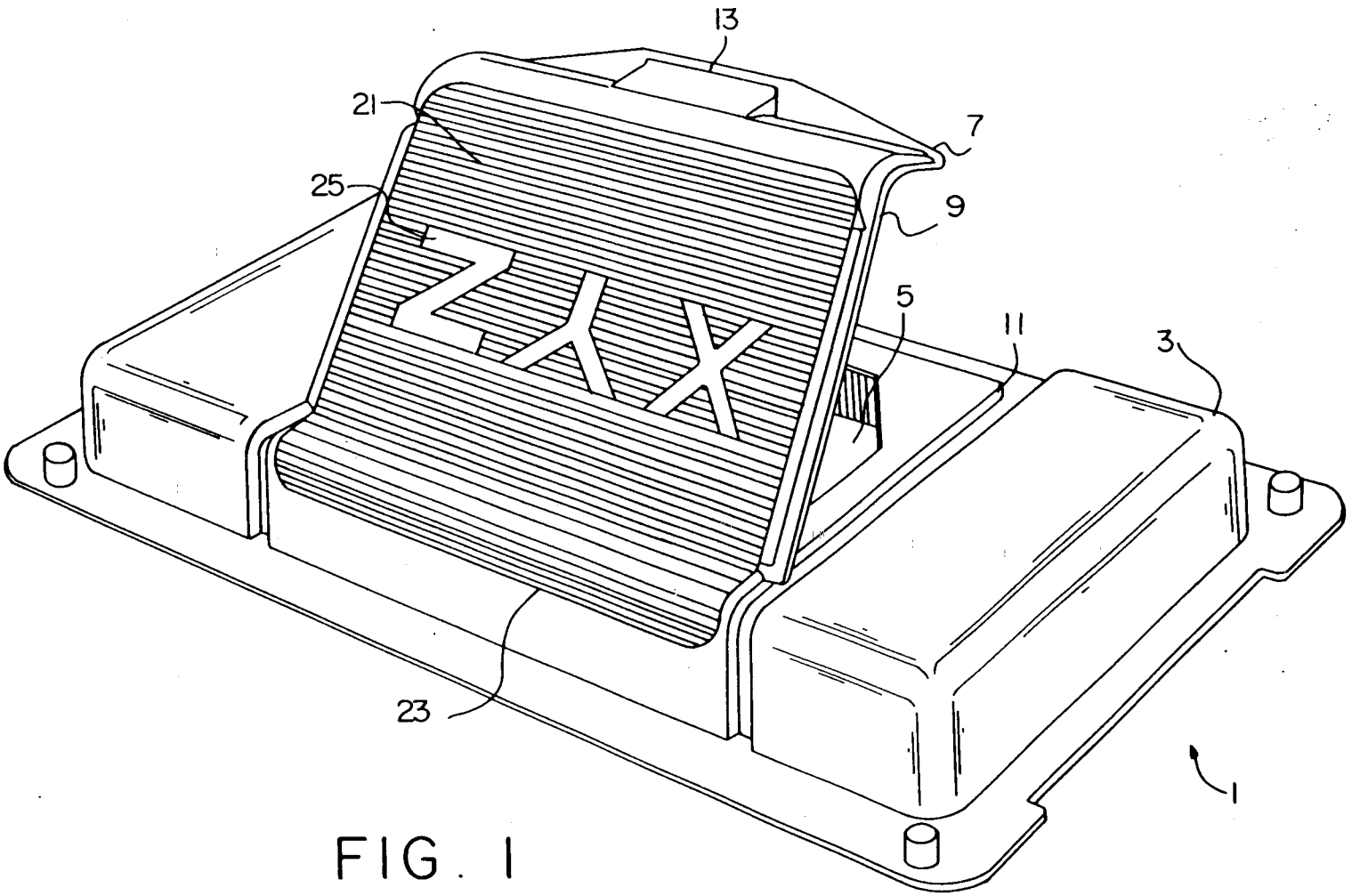
FIG. 1 of the drawings is a perspective view of the dispensing container in accordance with this invention.

In accordance with this invention it has been found that a dispensing container may be provided wherein a novel relationship may exist between a thermoformed tray and a semirigid lid wherein the two parts are adhered together by a flexible substrate having printing thereon whereby the flexible substrate not only acts as a hinge adhering the two parts together but has printed indicia thereon to identify and label the product being dispensed. Various other advantages and features will become apparent from a reading of the following description given with reference to the various figures of drawings. It is understood, however, that within the scope of this invention for any container having an opening therein to be covered with a lid which is hinged thereto by an adhesive substrate which bears indicia to convey useful information regarding the product contained therein. The following description is given with particular reference to a thermoformed container which has product therein:

FIG. 1 of the drawings illustrates the dispensing container 1 in accordance with this invention illustrating a thermoformed concave tray 3 having an opening 5 therein The opening 5 is covered by a thermoformed lid 7 which interlocks by its own contour 9 with the contour 11 of the tray 3. An opening 5 is provided therein for dispensing products such as folded and moistened towellettes therefrom.

Thermoformed semiflexible lid 7 is provided with a finger grip 13 to aid in the opening and closing thereof. A flexible adhesive substrate 21 is adhered to lid 7 and to tray 3 at 23 and provides for a hinging action between the lid 7 and tray 3. Flexible adhesive substrate 21 also provides a surface for the location thereon of printed indicia represented at 25 for the identification of the product contained within the concave thermoformed tray 3 for dispensing through opening 5.

The materials of construction are those materials which are well known for thermoforming such as polymers of ethylene and propylene as well as polyvinylchloride. The flexible adhesive substrate 21 is preferably formed of a polypropylene film having a rubber-based emulsion adhesive thereon for easy attachment to the thermoformed tray 3.

Figure 2:
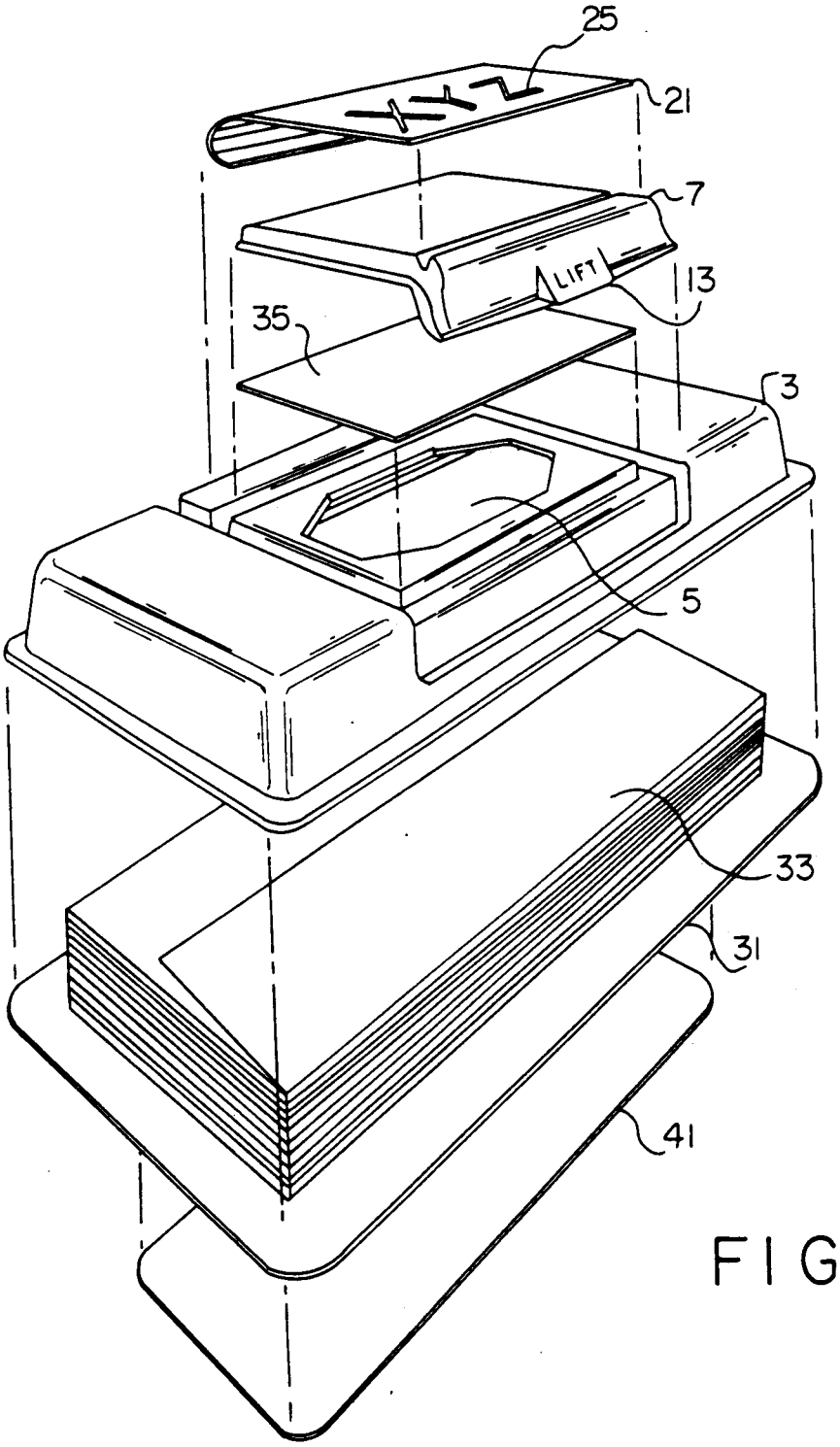
FIG. 2 of the drawings is a perspective assembly view of the dispensing container according to this invention.

FIG. 2 of the drawings illustrates in an assembly view the dispenser 1 of FIG. 1. As illustrated thereon, a bottom sheet 31 is provided to support product in the form of towellettes 33.

Thermoformed concave tray 3 attaches to the bottom sheet 31 and, by the concavity therein, defines a space for containing product 33. Thermoformed concave tray 3 defines the opening 5 which for shipment purposes is covered with an adhesive foil 35 which is thus located between the thermoformed concave tray 3 and thermoformed lid 7. Adhesive foil 35 has adhesive only located around its perimeter so as to attach to the tray 3 without adhering to any towellettes which may contact the bottom thereof. Adhesive substrate 21 having indicia 25 thereon adheres to the thermoformed semirigid lid 7 and the thermoformed concave tray 3 to form a hinge therebetween with the indicia 25 thereon identifying the product contained therein and dispensed therefrom. A bottom label 41 is illustrated for attachment to the bottom sheet 31.

It is thus seen that the product may be easily dispensed from opening 5 by simply lifting lid 7 at the finger hold 13 thereof and removal of product 33 through opening 5 in seriatim fashion. Upon removal of product through opening 5, lid 7 is snapped back over opening 5 due to the interlocking between mating surfaces 9 and 11. Such movement is brought about through the hinge-like action of substrate 21 which maintains the lid 7 and tray 3 in a desired relationship while simultaneously providing indicia which identifies the product dispensed therefrom.

It is thus seen that the dispensing container of this invention provides a novel dispensing container which provides a novel relationship between the connection of a cover or lid and the body of a container. As various other advantages and features will become apparent from a reading of the foregoing specification which is exemplary in nature, such variations are within the spirit and scope of this invention as defined by the following appended claims.

That which is claimed:

1. A package of premoistened towellettes for presentation upon a retail shelf comprising:

a bottom sheet;

a thermoformed concave tray attached to said bottom sheet and defining therebetween a space;

premoistened towellettes within said space;

said thermoformed concave tray defining an opening said opening being smaller than said premoistened towellettes;

a thermoformed semirigid lid covering said opening;

a flexible adhesive substrate attached to said thermoformed lid and said thermoformed concave tray hinging said thermoformed lid to said thermoformed concave tray; and printed indicia on said adhesive substrate.

2. The dispensing container in accordance with claim 1 further including an adhesive foil covering said opening and adhered to said thermoformed concave tray, said foil being covered by said thermoformed lid.

3. A package for presentation of product upon a retail shelf comprising:

a bottom sheet;

a thermoformed concave tray attached to said bottom sheet and defining therebetween a space;

product within said space;

said thermoformed concave tray defining an opening said opening being smaller than said product;

a flexible adhesive substrate attached to said thermoformed lid and said thermoformed concave tray hinging said thermoformed lid to said thermoformed concave tray; and printed indicia on said adhesive substrate.

* * * * *